US008866679B2

(12) United States Patent
Golko et al.

(10) Patent No.: US 8,866,679 B2
(45) Date of Patent: Oct. 21, 2014

(54) ANTENNA CLIP

(75) Inventors: Albert Golko, Saratoga, CA (US); Daniel W. Jarvis, Sunnyvale, CA (US); Felix Alvarez, San Jose, CA (US)

(73) Assignee: Apple Inc., Cupertino, CA (US)

( * ) Notice: Subject to any disclaimer, the term of this patent is extended or adjusted under 35 U.S.C. 154(b) by 915 days.

(21) Appl. No.: 12/703,937

(22) Filed: Feb. 11, 2010

(65) Prior Publication Data

US 2011/0193751 A1 Aug. 11, 2011

(51) Int. Cl.
*H01Q 1/24* (2006.01)
*H01Q 1/40* (2006.01)
*H01Q 1/08* (2006.01)

(52) U.S. Cl.
CPC ..... *H01Q 1/241* (2013.01); *H01Q 1/40* (2013.01); *H01Q 1/084* (2013.01)
USPC ..... 343/702; 343/873; 343/872

(58) Field of Classification Search
CPC ..... H01Q 1/243; H01Q 1/42; H01Q 1/38
USPC ..... 343/702, 873, 872
See application file for complete search history.

(56) References Cited

U.S. PATENT DOCUMENTS 5,551,069 A 8/1996 Harrison et al.
6,295,033 B1 9/2001 Chatzipetros et al.
6,810,237 B1 10/2004 McEowen
6,831,609 B2 12/2004 Shively et al.
6,897,827 B2 * 5/2005 Senba et al. ..... 343/873
7,551,142 B1 6/2009 Zhang et al.
7,612,725 B2 11/2009 Hill et al.
7,861,312 B2 12/2010 Lee et al.
7,911,387 B2 3/2011 Hill et al.
7,916,089 B2 3/2011 Schlub et al.
8,102,319 B2 1/2012 Schlub et al.
8,106,836 B2 1/2012 Hill et al.
8,138,977 B2 3/2012 Zhang et al.
2007/0188391 A1 * 8/2007 Tu et al. ..... 343/702
2007/0222681 A1 * 9/2007 Greene et al. ..... 343/700 MS
2008/0165065 A1 7/2008 Hill et al.
2008/0180331 A1 * 7/2008 Brady et al. ..... 343/705
2009/0040115 A1 * 2/2009 Zhang et al. ..... 343/702
2009/0051609 A1 * 2/2009 Packer et al. ..... 343/718
2009/0213029 A1 * 8/2009 Baliarda et al. ..... 343/906
2010/0045541 A1 * 2/2010 Aoki et al. ..... 343/702
2010/0321253 A1 * 12/2010 Ayala Vazquez et al. ..... 343/702

* cited by examiner

*Primary Examiner* — Dameon E Levi
*Assistant Examiner* — Collin Dawkins
(74) *Attorney, Agent, or Firm* — Brownstein Hyatt Farber Schreck, LLP

(57) ABSTRACT

Certain embodiments may take the form of an electronic device having a metal housing encapsulating operative circuitry for the device. The electronic device includes an attachment member coupled to the metal housing at an attachment point. An antenna is coupled to the attachment member and communicatively coupled to the operative circuitry in the metal housing via the attachment point to enable the electronic device to communicate wirelessly.

19 Claims, 7 Drawing Sheets

ANTENNA CLIP

BACKGROUND

1. Technical Field

The present invention relates to electronic devices receiving wireless transmissions and, more particularly, to providing an radio frequency (RF) radiating element in an attachment member of an electronic device.

2. Background Discussion

Small form factor electronic devices such as personal digital assistants, cell phones, mobile media devices and so on have become increasingly popular in today's society. They serve as work tools, communication devices and provide entertainment, among other functions, and are often carried by hand, clip or in a pocket. Many times, a smaller form factor device will be more popular or able to demand a higher retail price than a functionally equivalent larger device.

Generally, the processor and operative parts of electronic devices are enclosed in housings made of plastic, metal and/or glass that may provide an aesthetically pleasing appearance. The housings provide structural integrity to the devices and protect potentially sensitive component parts of the electronic devices from external influences.

For structural and aesthetic purposes, some electronic devices have a metal or significantly metal housing design. The metal housing creates challenges to providing communication capability, such as through radio frequency (RF) or other frequency transmissions, for the device. One technique for radiating out of a metal housing is creating a plastic cutout pocket. However, this may result in a surface color and texture difference in a finished product. Another technique includes limiting the material selection of the product enclosures to materials such as plastic that are transparent to the frequencies used in communication and thereby no longer using the metal housing.

The foregoing is believed to be helpful in providing the reader with background information to facilitate a better understanding of the various aspects of the present disclosure. Accordingly, it should be understood that these statements are to be read in this light, and not as admission of prior art

SUMMARY

Certain aspects of embodiments disclosed herein by way of example are summarized below. It should be understood that these aspects are presented merely to provide the reader with a brief summary of certain forms an invention disclosed and/or claimed herein might take and that these aspects are not intended to limit the scope of any invention disclosed and/or claimed herein. Indeed, any invention disclosed and/or claimed herein may encompass a variety of aspects that may not be set forth below.

Certain embodiments may take the form of an electronic device having a metal housing encapsulating operative circuitry for the device. The electronic device includes an attachment member coupled to the metal housing at an attachment point. An antenna is coupled to the attachment member and communicatively coupled to the operative circuitry in the metal housing via the attachment point to enable the electronic device to communicate wirelessly.

Another embodiment may take the form of a small form factor, metal housed electronic device. The device includes a metal housing and a radio frequency (RF) component located within the metal housing. An attachment member (which may be a clip) is moveably coupled to the metal housing and an antenna is located on the attachment member. A conduit communicatively couples the RF component and the antenna.

Yet another embodiment may take the form of a method of manufacturing a metallic, small form factor electronic device. The method includes milling a metal housing and a metal attachment member. A portion of the attachment member is relief cut and filled with an RF transparent material. An antenna is positioned in the relief cut portion of the attachment member. Components are secured within the metal housing, a conduit connection is provided external to the housing that is communicatively coupled to an RF component in the metal housing and the housing is sealed. The method includes communicatively coupling the antenna and the conduit and coupling the metal housing and the metal attachment member using a hinge pin.

DETAILED DESCRIPTION

Certain embodiments may take the form of an electronic device having a metal housing and an attachment member (which may be a clip) with an antenna. The antenna is positioned in the attachment member to facilitate receipt of data transmitted as waveforms by positioning the antenna at least a threshold distance away from the metal housing acting as a ground plane. The threshold distance may vary based on the frequency band, sensitivity, and/or efficiency for which the antenna is designed to operate. In particular, the threshold distance depends highly upon the frequency spectrum for an RF antenna. For example, for Wi-Fi, Bluetooth®, and so forth, the threshold distance may be approximately 1.25 mm or greater, such as 2, 3 or 4 mm and up, including distances in between. In a cellular frequency spectrum, the threshold distance may be different depending on if a tri-band, quad-band or penta-band antenna is used. The threshold distance in the cellular frequency can vary from approximately 7 to 14 mm.

The antenna is coupled to an RF component located within the metal housing with an electrical conduit. The placement of the antenna in the attachment member may conceal the antenna member from casual view, in addition to potentially protecting it from damage that may be suffered if the antenna extended outward from the surface of the electronic device.

While the RF frequency band is specifically mentioned herein, it should be appreciated that other frequency bands may similarly be accommodated. That is devices and antennas that utilize and operate in frequency bands outside of the RF band may be implemented. As such, while RF is used throughout as an example, but other frequency bands are embraced by the present disclosure. Additionally, it should be appreciated that the foregoing threshold distances are given as examples and in an actual implementation other distances besides those mentioned may be used.

In some embodiments the attachment member is also formed from a metal. Hence, a relief cut may be made in the attachment member and filled with an RF transparent material, such as a plastic. The antenna may be coupled to the RF transparent material. In other embodiments, the antenna may be located outside the metallic housing. For example, in one embodiment, a hinge pin may serve as the antenna.

Figure 1:
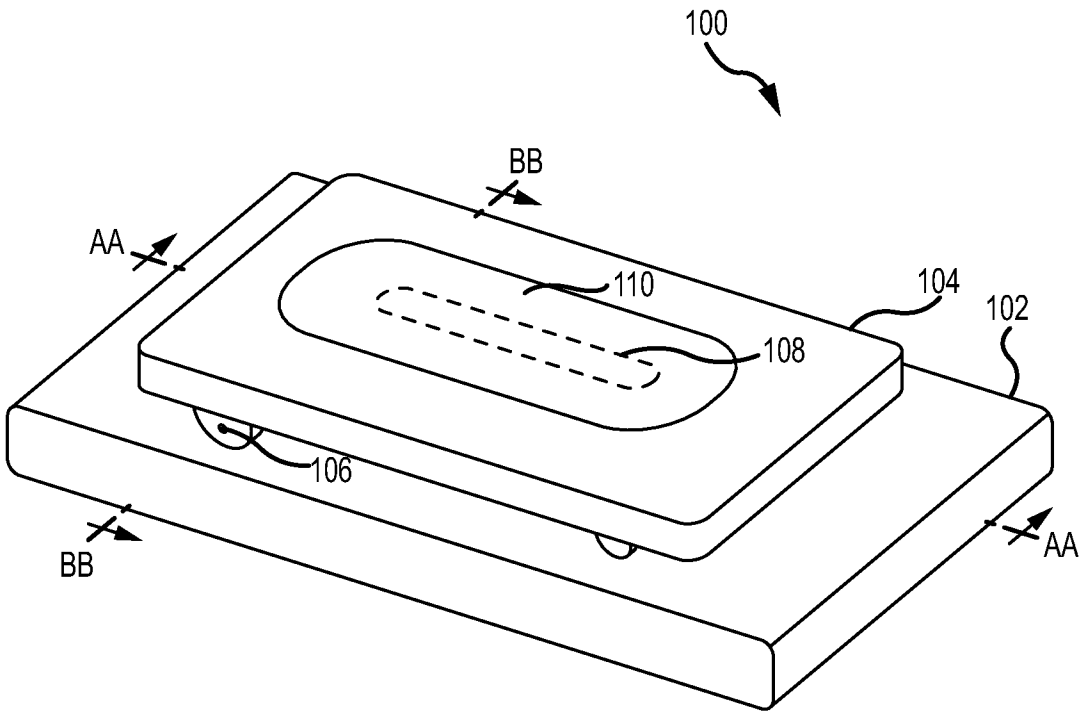
FIG. 1 illustrates a small form factor electrical device having an antenna located in an attachment member.

FIG. 1 illustrates an example electronic device 100 in accordance with an example embodiment. The electronic device 100 may be configured to function as an media recorder/playback device such as an MPEG3 player, a radio, an audio/video recorder, a mobile telephone, personal digital assistant, tablet computing device, or other similar device. In certain embodiments, the electronic device 100 has a body 102 (sometimes also referred to as a housing) with an all metal, or primarily metal, exterior or layer. In other embodiments, a significant portion (such as a back or other side) of the body 102 of the device may be made from metal or primarily from metal. The body 102 may be made, in part or in whole, of aluminum, magnesium, aluminum alloy, magnesium alloy, or other metal or metal alloy. There may be one or more apertures in the metal body configured to allow for input/output functionality. For example, an aperture may be provided with one or more buttons to turn on/off the device 100 and/or control the operations of the device 100. Additionally, an aperture may be provide to allow for headphones to connect to with the electronic device 100. In other embodiments, however, one or fewer apertures are provided and the input/output is conducted wirelessly.

The electronic device 100 may have a small form factor such that it is easily carried in a hand or pocket. Typically, an attachment member 104 is coupled to the electronic device 100 to allow the electronic device 100 to be attached in a convenient location for a user, such as clipped on an article of clothing. In some embodiments, the attachment member may be coupled to the housing 102 via a coupling pin 106 that passes through flange members of the attachment member 104 and the housing 102. A spring member (not shown) may be provided to maintain the attachment member 104 in a closed position and to hold the attachment member 104 when attached in a particular place. The attachment member 104 is coupled to the housing such that it is adjacent to the metal housing 102 or portions of the housing that are made of metal or substantially of metal.

The attachment member 104 may be made of the same metal or other material as the housing 102 of the electronic device 100. As such, the attachment member 104 and the housing 102 may serve as ground planes, thereby potentially interfering with the use of antennas with the electronic device 100. As one example, close proximity of a ground plane (e.g., the housing 102) may reduce inductance and impedance of an antenna, resulting in the antenna presenting a capacitive load and influencing the radiation pattern of the antenna.

To facilitate the use of an antenna, the antenna may be placed in or proximate to the attachment member 104. Specifically, a portion of the metallic attachment member 104 may be omitted and an antenna 108 may be positioned within the omitted portion of the attachment member 104. Additionally, an RF transparent material 110 may be used to fill the omitted portion of the attachment member 104. The antenna 108 may be affixed to, located within, or otherwise located adjacent to the RF transparent material 110.

Figure 2:
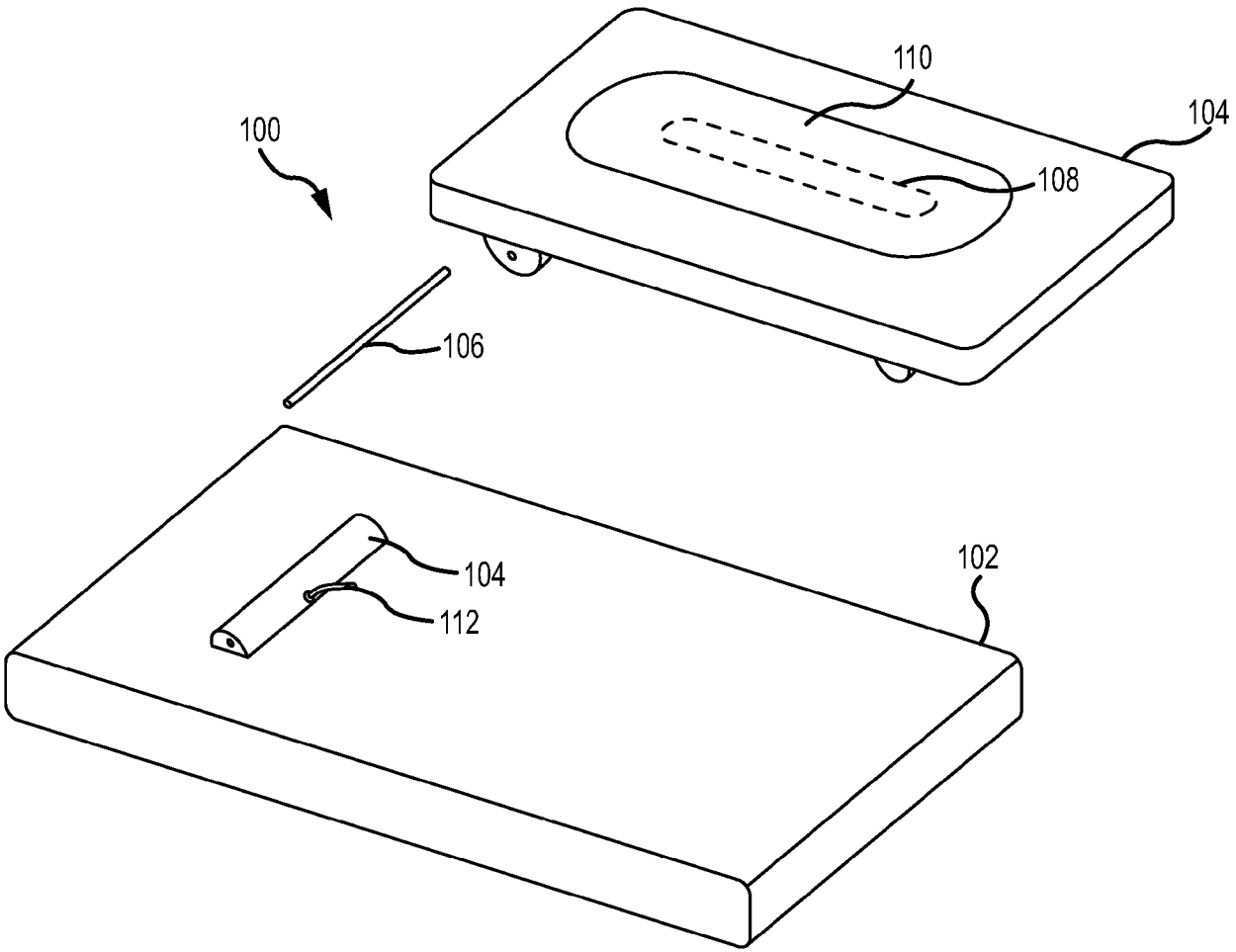
FIG. 2 illustrates an exploded view of the attachment member of FIG. 1.

FIG. 2 is an exploded view of the attachment member 104 of the electronic device 100 of FIG. 1. In the exploded view, an electrical conduit 112 is shown exiting the housing 102 via a flange 114 of the housing 102. A ground line of the conduit may be coupled to the housing 102. The electrical conduit 112 couples the antenna 108 with the RF device in the housing. The electrical conduit 112 may be any suitable electrically conductive member including a coaxial cable, flex microstrip, or the like. The electrical conduit 112 may flex and bend to move with the attachment member 104.

Figure 3:
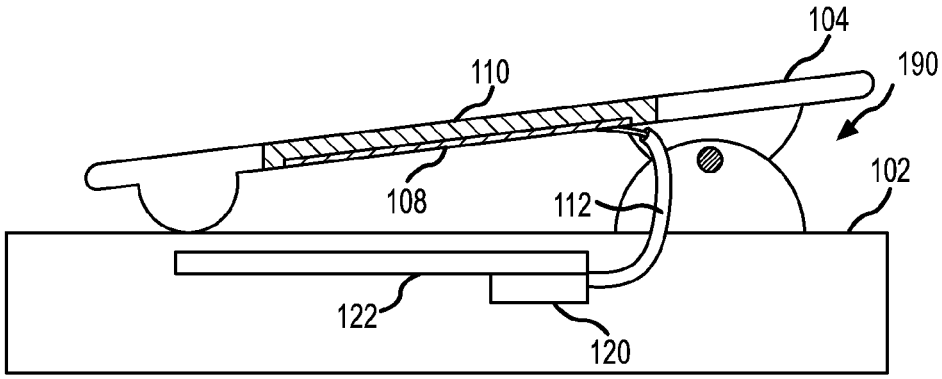
FIG. 3 illustrates a cross-sectional view of the electrical device of FIG. 1 taken along line AA in FIG. 1.

FIG. 3 is a cross-sectional view of the electronic device 100 showing an embodiment having the electrical conduit 112 fixed (for example, soldered) to the antenna 108 to create an electrically conductive pathway between the electrical conduit 112 and the antenna 108. When the attachment member 104 is opened and closed, the electrical conduit 112 moves with the attachment member 104. To limit the movement of the conduit 112, the attachment point of the conduit 112 and the antenna 108 may be near the hinge 190 of the attachment member 104. Limiting the movement of conduit 112 may in turn reduce or limit the amount of stress on the fixed point between the antenna 108 and the conduit 112.

In FIG. 3, the electrical conduit 112 is also shown connected to an RF component 120. The RF component 120 may be configured to receive and transmit RF signals through the antenna 108 in accordance with an RF standard and/or a particular communication protocol, and within a particular frequency band. For example, the RF component 120 may be configured to operate according Bluetooth® protocol, a WiFi protocol, or other such communication protocol. In some embodiments, the RF component 120 and antenna 108 may be configured to operate in the 2.4 GHz range, or may similarly be configured to operate in any other suitable band. The antenna 108 may have a length approximately ¼ or ½ of the wavelength of the operating frequency in certain embodiments. In other embodiments, the antenna 108 may have other lengths.

The RF component 120 is typically coupled to a printed circuit board (PCB) 122 on which the circuitry of the electronic device 100 is located. For example, a processor, memory, and other components may be located on the PCB 122. In some embodiments, the processor, memory, and RF component, as well as other components, may be integrated into a single chip (e.g., a system on chip) or an application specific integrated circuit located on the PCB 122 to further consolidate components within the housing 102.

Figure 4:
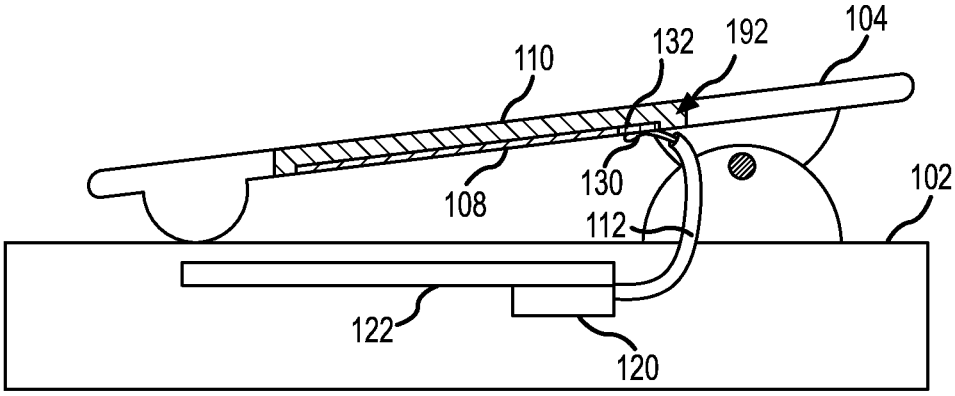
FIG. 4 illustrates a cross-sectional view of the electrical device of FIG. 1 taken along line AA in FIG. 1 in accordance with an alternative embodiment.

FIG. 4 is another cross-sectional view of another embodiment of the device 100 illustrating a slidable coupling 192 for the antenna 108 and the conduit 112. As illustrated, an exposed end 130 of the conduit 112 is shaped to make contact with a conductive pad 132. The conductive pad 132 is conductively coupled with the antenna 108 and the antenna is positioned with the RF transparent material 110 in the omitted portion of the attachment member 104. Hence, when the exposed end 130 of the conduit 112 contacts the conductive pad 132, the antenna 108 is electrically coupled with the conduit 112 and the RF component 120. The shape of exposed end 130 of the conduit 112 is such that it flexes when pressed and extends when pressure is removed and has a spring-like characteristic. As such, the exposed end 130 may maintain contact with the conductive pad 132 when the attachment member 104 is opened or closed. However, the conductive pad 132 and the exposed end 130 of the conduit 112 are not necessarily fixed together. This allows for movement of the exposed end 130 relative to the conductive pad 132 and vice versa.

Figure 5:
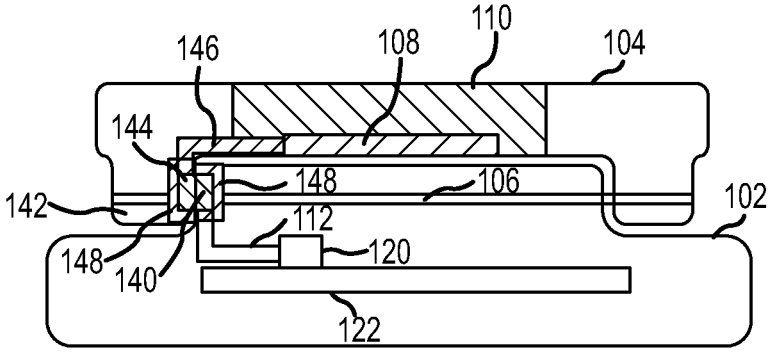
FIG. 5 illustrates a cross-sectional view of the electrical device of FIG. 1 taken along line BB in FIG. 1 in accordance with another alternative embodiment.

FIG. 5 is a cross-sectional view of another embodiment of the device 100, illustrating a rotatable coupling for the antenna 108 and the conduit 112. The conduit 112 may be routed to a first conductive member 140 located at an edge of the housing flange 114 that faces an edge of an attachment member flange 142. A corresponding second conductive member 144 may be located on the attachment member flange 142. The second conductive member 144 is typically coupled to an additional electrical conduit 146 which is further coupled to the antenna 108.

In one embodiment, the first and second conductive members 140, 144 are located around the hinge pin 106. In other embodiments, the first and second conductive members 140, 144 are located adjacent to the hinge pin 106. In some embodiments, one or both of the members may be complete circles, semicircles or other shapes. Additionally, the first and second conductive members 140, 144 are configured to contact each other to allow for electrical signals to flow therethrough. In some embodiments, the conductive members may have a convex or conical shape to facilitate contact therebetween. Further, insulating material 148 may be used to separate the first and second conductive members from the metallic housing 102 and the metallic attachment member 104.

Figure 6:
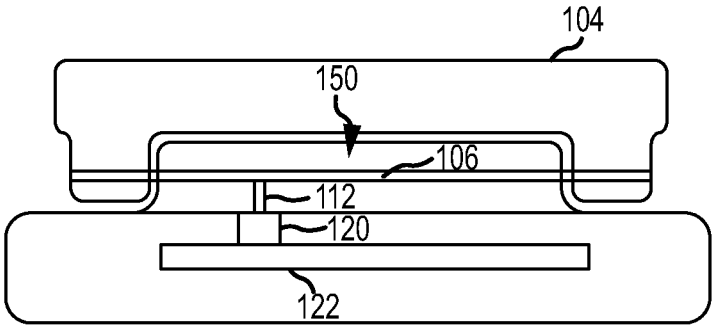
FIG. 6 illustrates a cross-sectional view of the electrical device of FIG. 1 taken along line BB in FIG. 1 in accordance with yet another alternative embodiment.

FIG. 6 illustrates yet another alternative embodiment wherein the hinge pin 106 is used as an antenna 150. In this embodiment, the housing flange 114 is an RF transparent material so that it does not interfere with RF reception and transmission by the antenna 150. The electrical conduit 112 may be coupled between the hinge pin 106 and the RF component 120. In some embodiments, a portion of the housing 102 and/or attachment member 104 may also be RF transparent material to further limit their influence on RF signals and the operation of the antenna 150.

Often, data transfer between electronic devices is performed via physical connections. As one example, a common connector type for small form factor electronic devices is a 30 pin connector. In some instances, the 30 pin connector consumes between 20 and 30% of the total size of the associated device. Another common connector for small form factor devices is the 3.5 mm headphone jack. Implementation of a wireless structure to transfer data, such as certain embodiments described herein, between devices may obviate use of the 30 pin connector and other connectors, thus allowing for a smaller sized device. Alternatively, or additionally, the removal of one or more physical connectors may allow for increases in battery size, memory size, or other components and/or the addition of other components that may increase the utility of the devices.

Additionally, placing the antenna element in the attachment member 104 rather than within the housing 102 reduces the number of openings in the metal housing 102 allowing for the metalhousing 102 to be better sealed and increasing the strength of the housing 102. That is, because there is no need to provide an RF transparent region in the housing 102 and a reduced number of physical connectors (i.e., in relief regions), the metal housing 102 may be better sealed and may provide greater structural integrity. The better seal better prevents water intrusion. Moreover, the increased strength in the housing 102 may allow for the use of different and/or thinner materials to be used for the housing and may further allow for a different finishing to provide a more distinguishing aesthetic appearance. Furthermore, because the housing 102 requires fewer relief cuts, the manufacturing process may be streamlined and more efficient, saving time and money.

Figure 7:
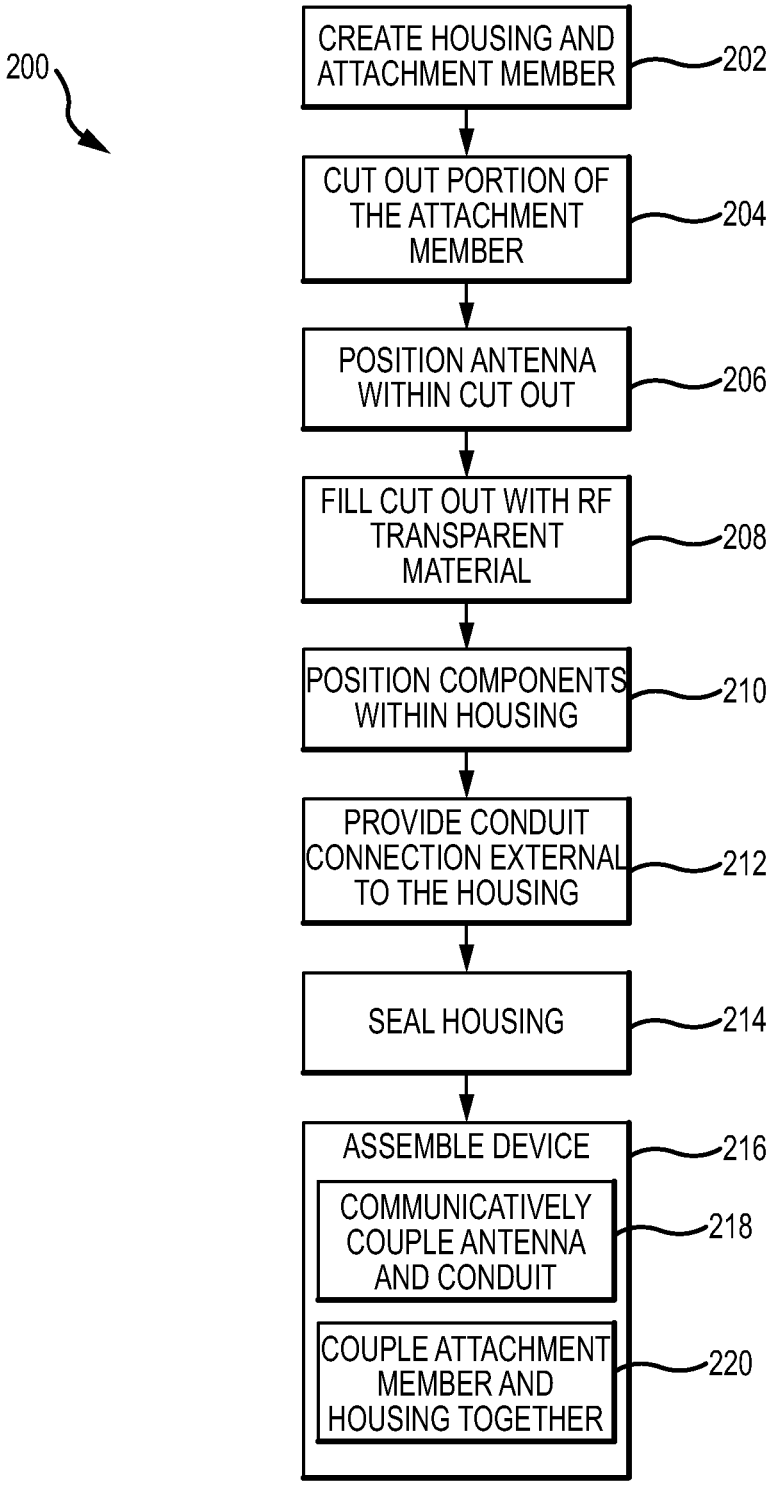
FIG. 7 is a flowchart of an example method of manufacturing the electronic device.

FIG. 7 illustrates an example method of manufacturing 200 the electronic device 100. The method 200 may begin by creating the metal housing 102 and the attachment member 104 (Block 202). Any suitable process may be implemented to form the metal housing 102 and the attachment member 104, including casting (e.g., die casting), milling (e.g., computer numerical control (CNC) milling), or extrusion, for example, or other suitable processes. In some embodiments, more than one process may be employed.

A relief cut is made in the attachment member 104 (Block 204) and the antenna 108 is positioned within the relief cut (Block 206). The relief cut is then filled with RF transparent material (Block 208). The RF transparent material may be plastic, glass, ceramic, composites, or any other suitable material. In some embodiments, the antenna 108 is positioned adjacent to the RF transparent material, while in other embodiments, the antenna 108 may be positioned or sandwiched within the RF transparent material. In one embodiment, the antenna is insert molded into the relief cut of the attachment member 104. In other embodiments, an aperture may be created in the RF transparent material for placement of the antenna. In any event, the antenna 108 is positioned at least a threshold distance away from the housing 102 by its placement in the attachment member 104. Additionally, the antenna 108 is positioned at least a threshold distance away from the metal of the attachment member 104. Hence, the relief cut in the attachment member 104 is at least large enough to provide the threshold distance for operation of the antenna 108.

The PCB 122 with the RF component 120, as well as any other components (such as a battery)(, are positioned within the housing 102 (block 210). In some embodiments, the PCB may be secured to the housing with screws, an adhesive or with an interference fit. That is, the PCB may fit securely within the housing 102 simply because the interior of the housing 102 is small in the small form factor design.

The electric conduit 112 is provided external to the housing 102 so that is may be coupled to the antenna 108 (Block 212). As previously mentioned, the electrical conduit 112 may be fixed relative to the antenna 108 or may be movably coupled to the antenna 108. In particular, the conduit 112 may be slidably or rotatably coupled to the antenna 108 to reduce stress and wear on the conduit 112 and the antenna 108.

The housing 102 is then sealed (Block 214). The manner in which the housing 102 is sealed will depend on the housing design and how the housing is made. For example, in one embodiment, the housing 102 may be made with two housing members that are coupled together to form (and seal) the housing 102. In other embodiments, the housing 102 may have an elongated, hollow body that may be sealed with an end cap. The end cap may be coupled to the elongated, hollow body with one or more securing members, such as screws, or with an adhesive, for example.

Once the antenna 108 is positioned and the housing 102 is sealed, the electronic device 100 is assembled (Block 216). Assembly of the electronic device 100 includes communicatively coupling the antenna 108 to the conduit 112 (Block 218) and coupling the attachment member 104 to the housing 102 (Block 220) using a hinge pin, for example. It should be appreciated that some embodiments may include variations of the general method. For example, the order of operations may be changed and/or certain operations may be omitted. Additionally, in some embodiments, the device may be assembled before sealing housing.

Although various specific embodiments have been described above, it will be apparent to those having skill in the art that alternative arrangements and configurations not specifically shown or described herein may be achieved without departing from the spirit and scope of the present disclosure. Indeed, there may be other ways to couple an electrical conduit to an antenna beyond those shown in the drawings and described herein. As such, the embodiments described herein are intended as examples and not as limitations.

The invention claimed is:

1. An electronic device comprising:

a metal housing encapsulating all operative circuitry for the device;

an attachment member that encapsulates no operative circuitry for the device coupled to the metal housing at an attachment member hinge; and an antenna at least partially enclosed within a radio frequency transparent material at least partially enclosed within the attachment member and communicatively coupled to the operative circuitry in the metal housing via the attachment member hinge, wherein the attachment member maintains the antenna a threshold distance away from the metal housing at all times, the threshold distance being a distance at which the metal housing does not interfere with operation of the antenna.

2. The device of claim 1, wherein the antenna is communicatively coupled to the operative circuitry with a coaxial conduit routed through the attachment member hinge.

3. The device of claim 1, wherein the antenna is communicatively coupled to the operative circuitry via a flex microstrip.

4. The device of claim 1, wherein the antenna is communicatively coupled to the operative circuitry via a slidable coupling.

5. The device of claim 4, wherein the slidable coupling comprises:

a first conductive member fixed to a surface of the metal housing proximal to the attachment member hinge and communicatively coupled to the operative circuitry; and a second conductive member fixed to a surface of the attachment member at the attachment member hinge and communicatively coupled to the antenna, wherein the first and second member are rotatably, electrically coupled.

6. The device of claim 4, wherein the slidable coupling comprises:

an electrical conduit coupled the operative circuitry, the electrical conduit passing through the attachment member hinge and having an exposed terminal end; and a conductive pad positioned on a surface of the attachment member, the conductive pad being coupled to the antenna, wherein the exposed terminal end of the electrical conduit contacts the contact pad.

7. The device of claim 6 wherein the exposed terminal end of the electrical conduit is shaped to provide a spring-like characteristics.

8. The device of claim 1, wherein the attachment member is configured to rotate relative to the housing at a coupling point.

9. The device of claim 1, wherein the attachment member is configured to clip on to an article of clothing.

10. A small form factor, metal housed electronic device comprising:

a metal housing encapsulating all operative circuitry for the electronic device;

a radio frequency (RF) component located within the metal housing;

an attachment member moveably coupled to the metal housing that encapsulates no operative circuitry for the electronic device;

an antenna located on the attachment member, wherein the antenna is at least partially enclosed within the attachment member which maintains the antenna a threshold distance away from the metal housing at all times, the threshold distance being a distance at which the metal housing does not interfere with operation of the antenna; and a conduit communicatively coupling the RF component and the antenna.

11. The electronic device of claim 10 wherein the attachment member is coupled to the metal housing via a hinge pin and the conduit passes adjacent to the hinge pin.

12. The electronic device of claim 10 wherein the antenna is compatible with RF signals in the 2.4 GHz band.

13. The electronic device of claim 10, wherein the attachment member is metal and the antenna is at least partially enclosed within a cutout portion of the attachment member.

14. The electronic device of claim 10 wherein the conduit comprises one of a flex microstrip or a coaxial connection.

15. The electronic device of claim 10 wherein conduit is movably coupled to the antenna.

16. The electronic device of claim 15 wherein the conduit is rotatably coupled to another conduit at a coupling point of the attachment member and the metal housing.

17. The electronic device of claim 15 wherein the conduit is configured to contact a contact pad, the contact pad being coupled to the antenna.

18. A method of manufacturing a metallic, small form factor electronic device comprising:

milling a metal housing;

milling a metal attachment member;

relief cutting a portion of the attachment member;

filling the relief cut portion of attachment member with an RF transparent material;

positioning an antenna at least partially enclosed within the relief cut portion of the attachment member which maintains the antenna a threshold distance away from the metal housing at all times, the threshold distance being a distance at which the metal housing does not interfere with operation of the antenna;

securing components within the metal housing, the metal housing encapsulating all operative circuitry for the electronic device and the attachment member encapsulating no operative circuitry for the electronic device;

providing a conduit connection external to the housing that is communicatively coupled to the RF component in the metal housing;

sealing the metal housing;

communicatively coupling the antenna and the conduit; and coupling the metal housing and the metal attachment member using a hinge pin.

19. The method of claim 18 wherein positioning the antenna comprises insert molding the antenna into the relief cut portion of the attachment member.

* * * * *